United States Patent [19]

Morrow, Sr. et al.

[11] 4,005,780

[45] Feb. 1, 1977

[54] BOOM STOP AND BACK HITCH COMPENSATING SYSTEM

[75] Inventors: James G. Morrow, Sr.; David J. Pech, both of Manitowoc, Wis.

[73] Assignee: The Manitowoc Company, Inc., Manitowoc, Wis.

[22] Filed: Nov. 10, 1975

[21] Appl. No.: 630,426

[52] U.S. Cl. ..... 212/8 R; 212/59 A

[51] Int. Cl.[2] ..... B66C 23/00

[58] Field of Search ..... 212/48, 35 AC, 59 R, 212/9, 59 A, 8, 39, 58 R; 254/189; 214/142

[56] References Cited

UNITED STATES PATENTS

| | | | |
|---|---|---|---|
| 2,627,985 | 2/1953 | Sathre et al. | 212/59 A |
| 3,092,261 | 6/1963 | Nesbit | 212/39 R |
| 3,278,925 | 10/1966 | Saunders et al. | 212/39 R |
| 3,871,527 | 3/1975 | Schimmeyer et al. | 254/189 |

*Primary Examiner*—Robert J. Spar
*Assistant Examiner*—Lawrence J. Oresky
*Attorney, Agent, or Firm*—Leydig, Voit, Osann, Mayer & Holt, Ltd.

[57] ABSTRACT

The back hitch assembly for a lift or tower crane includes a tension sensing device which regulates the pressure delivered to the boom stop or hold back cylinders such that as the boom hoist line and back hitch become slack when the load line is relieved more pressure is delivered to the cylinders to counteract the rearward pull on the boom or tower due to the suspended weight of the masts and equalizer assemblies.

10 Claims, 6 Drawing Figures

48
49
26
44
28
43
45
27
46
29
70
41
71
10
30
40
31
24
37
13
36
32
33
25
20
47
42
22
21
12
15
35
23
18
19
17
14
16
14

83
84
86
85
82
90
89
29
81
87
88
27
28
29
30
90
80
91
13
32
92
12
35

BOOM STOP AND BACK HITCH COMPENSATING SYSTEM

The present invention relates generally to load handling devices and more particularly concerns a boom stop and back hitch compensating system for large lift or tower cranes.

One of the difficulties with large lift or tower cranes is that the weight of the boom hoist rigging including the multi-part line, equalizer assemblies and the heavy masts exerts a substantial backward pull on the boom or tower when the load on the lift line is relieved. While this backward pull is generally opposed by cushioned boom stops on lift cranes and/or hold back lines and cylinders on tower cranes, these devices sometimes bottom out when a large load is put down at a short reach. Conversely, when a load is picked up, it is desirable to reduce the pressure in the hydraulic boom stops or hold back cylinders in order to decrease the stresses imposed on the boom or tower during lifting.

Accordingly, it is the primary aim of the present invention to provide an automatic pressure compensating system for the boom stops and hold back cylinders of large lift and tower cranes. It is a more particular object to provide such a compensating device which senses tension in the back hitch or boom hoist rigging and automatically regulates the pressure delivered to the boom stops or hold back cylinders.

A more specific object is to provide a compensating system of the above type which is sensitive to slack in the boom hoist line and which includes a pressure multiplier for significantly increasing the pressure in the boom stop or hold back cylinders as the boom hoist line becomes slack.

It is a further and related object to provide such a compensating system with an automatically actuated valve for trapping fluid in the boom stops or hold back cylinders when the crane engine is not operating.

These and other objects and advantages of the invention will become apparent upon reading the following detailed description and upon reference to the drawings in which.

While the invention will be described in connection with a preferred embodiment, it will be understood that we do not intend to limit the invention to that embodiment. On the contrary, we intend to cover all alternatives, modifications and equivalents as may be included within the spirit and scope of the invention as defined by the appended claims.

Figure 1:
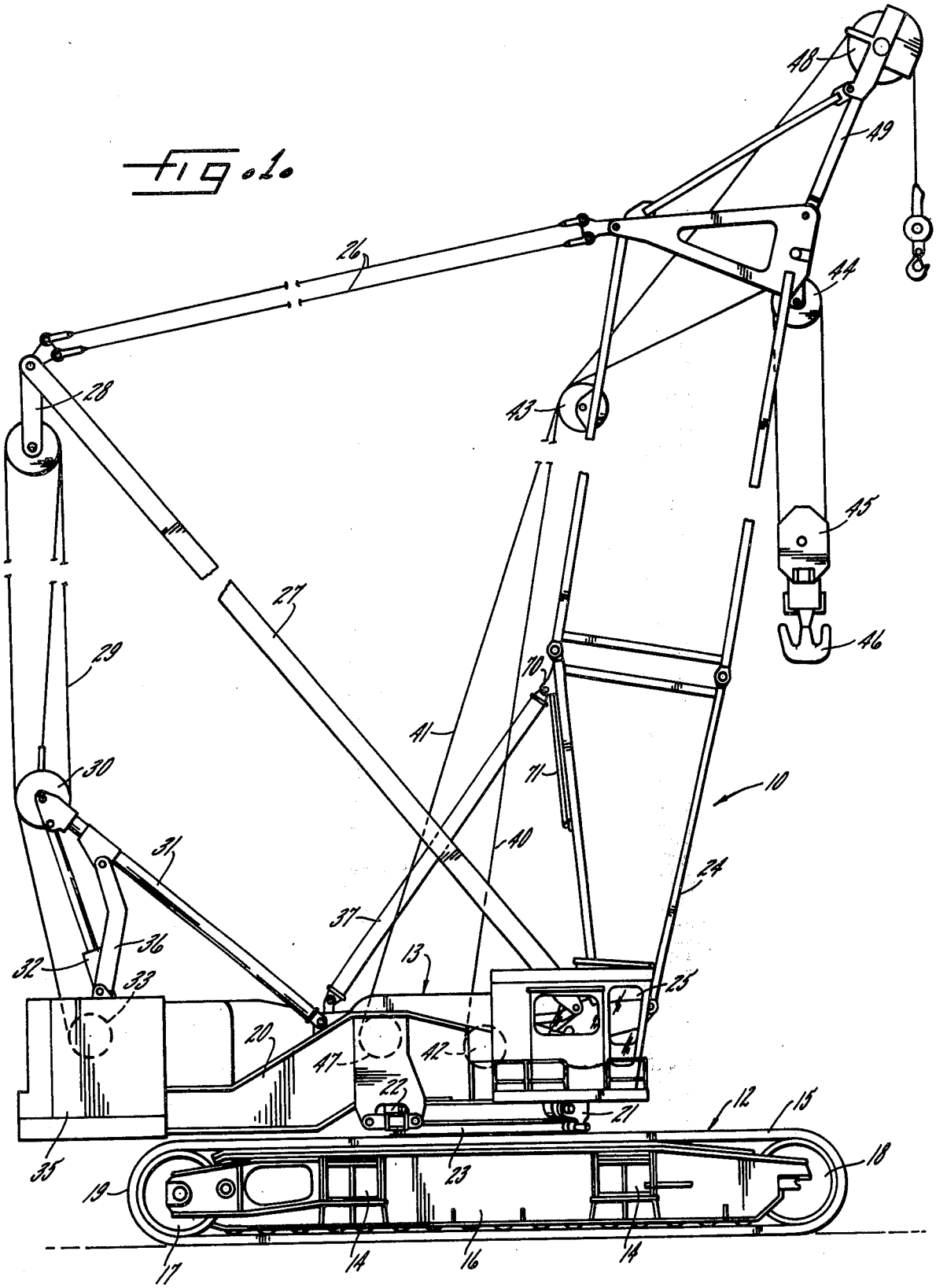
FIG. 1 is a side elevation of a lift crane embodying the boom stop and back hitch compensating system of the present invention.

Turning now to the drawings, there is shown in FIG. 1 a load handling device in the form of a lift crane assembly 10, with which the present invention is associated. The crane assembly 10 includes lower works 12 and upper works 13. The lower works 12 includes a pair of transverse beams 14 the ends of which are supported by a pair of traction assemblies 15 (only one of which is shown). Each traction assembly 15 includes side frames 16 which support a drive sprocket 17 and an idler sprocket 18 around which a crawler tread 19 runs.

The upper works 13 of the crane assembly 10 includes a rotatable bed 20 supported by front and rear roller assemblies 21, 22 which engage a ring gear and roller path 23 on the lower works 12. A working boom 24 is pivotally connected to the forward end of the rotatable bed 20 by a boom carrier 25 in the form of a pair of laterally spaced butt plates (only one of which is shown). The boom 24 is supported by two pairs of laterally spaced pendants 26 (only one pair of which is shown) extending rearwardly to the upper ends of laterally spaced masts 27, which carry an equalizer assembly 28 around which a boom hoist line 29 runs. Another equalizer assembly 30 is carried by the upper end of a pair of pivotally mounted gantry members 31 which are raised and held in position by a back hitch assembly in the form of a pair of hydraulic cylinders 32 (only one of which is shown). Preferably, the boom hoist line 29 forms a multi-part line between the equalizer assemblies 28, 30 and the opposite ends of the line are each wound on one drum of a dual drum boom hoist 33 at the rear of the upper works 13. In order to accommodate heavy loads, the crane 10 carries, at the rear of the rotatable bed 20, a large counterweight 35 which is coupled to the gantry member 31 by links 36.

As will be appreciated by those skilled in the art, the foregoing components of the crane 10, although illustrated somewhat schematically, are shown in FIG. 1 in substantially their normal operating positions. To prevent overcentering of the boom 24, the upper works 13 also carries automatic, cushioned boom stopss 37, in the form of hydraulic cylinders. The boom stops 37 are of substantial length and begin to cushion the rearward movement of the boom 24 when it is raised to about 65° from the horizontal. As shown in FIG. 1, the boom 24 is raised to an angle of about 81° from the horizontal, which is the maximum normal working angle for close in working, and the boom stops 37 are substantially retracted. When the boom 24 is pulled up to about 85° from the horizontal, the boom stop cylinders 37 bottom out forming rigid mechanical braces and they lose their hydraulic cushioning ability.

The illustrated crane 10 is also equipped with two lift lines 40, 41. The front lift line 40 is wound on a drum 42 and extends over a sheave 43 on the rear side of the boom 24 and then makes a double reach between upper and lower equalizer assemblies 44, 45, respectively, carried by the boom and a main hook assembly 46. The rear lift line 41 is wound on another drum 47 and extends over another sheave 43 and then over an upper pulley assembly 48 mounted on the end of a boom extension 49. It will also be understood that the upper works 13 carries a suitable power source, such as a diesel engine (not shown) and appropriate variable control power transmission means for the major functions of the crane including hydraulic pump means and controls (not shown) for the back hitch cylinders 32.

As those skilled in the art will appreciate, when a load is suspended by one of the load lines 40, 41 the forward pulling force on the boom 24 is opposed and substantially balanced by the tension forces in the pendants 26, boom hoist line 29 and back hitch cylinders 32. However, when the load is set down, the forward pulling force on the boom 24 and the tension in the boom hoist line 29 are substantially relieved. The boom is now subjected to a backward pulling force through the pendants 26 due to the overhanging weight of the mast 27 and the upper equalizer assembly 28. In very large lift cranes 10, the combined effective weight of these components 27, 28 is substantial (e.g., as much as ten tons or more) and when the boom 24 is raised to its maximum working position for short reaches, as shown in FIG. 1, this large rearward force causes the boom stops 37 to bottom out when the load on the lift line (40, 41) is set down.

In accordance with the present invention, compensating means are provided for increasing the fluid pressure in the cushioned boom stops 37 when the tension load on the boom hoist line 29 is reduced.

Referring now to FIGS. 2–5, the compensating means includes a sensing device 50 mounted on the frame of the lower equalizer assembly 30 for detecting changes in the tension of the boom hoist line 29, as it crosses over between multi-sleeve block assemblies **30*a* and 30*b* carried on opposite sides of the equalizer frame. In the preferred embodiment, the sensing device 50 has a pivotally mounted lever or bell crank 51 which carries a pulley 52 at one end biased into engagement with the hoist line 29 by a spring 53 connected to the other end of the crank 51 and a bracket 54 secured to the equalizer assembly frame. For adjusting the spring tension, a threaded nut and bolt assembly 55 connects the spring 53 to the bracket 54**.

Figure 3:
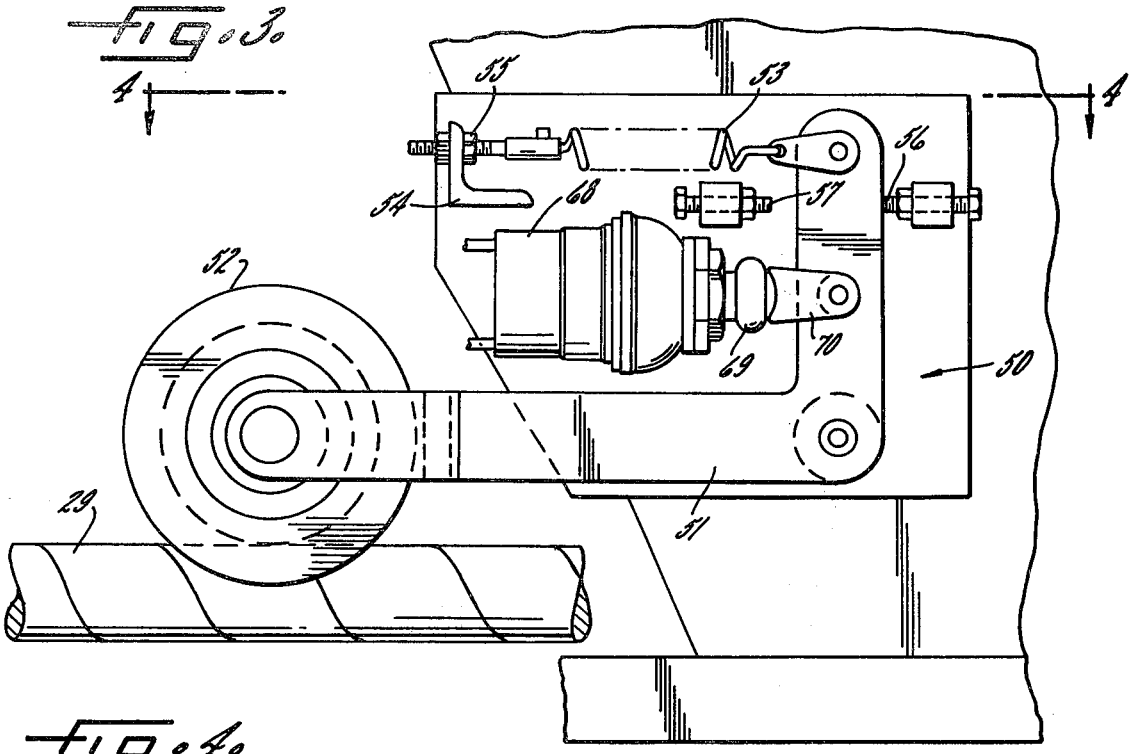
FIG. 3 is still a further enlarged, fragmentary elevation of the sensing mechanism for the compensating system of the present invention.

As mentioned above, when a load is suspended from the boom 24 by one of the lift lines 40, 41 the boom hoist line 29 and back hitch 32 are subjected to tension loading drawing the line 29 up against the pulley 52 and rotating the bell crank 51, clockwise as shown in FIG. 3, against the bias of the spring 53. When the load is set down, the line 29 begins to slacken and the spring 53 rotates the lever 51 and pulley 52 in the opposite direction. Adjustable stops 56 and 57 are provided to limit movement of the bell crank 51 in either direction.

Figure 5:
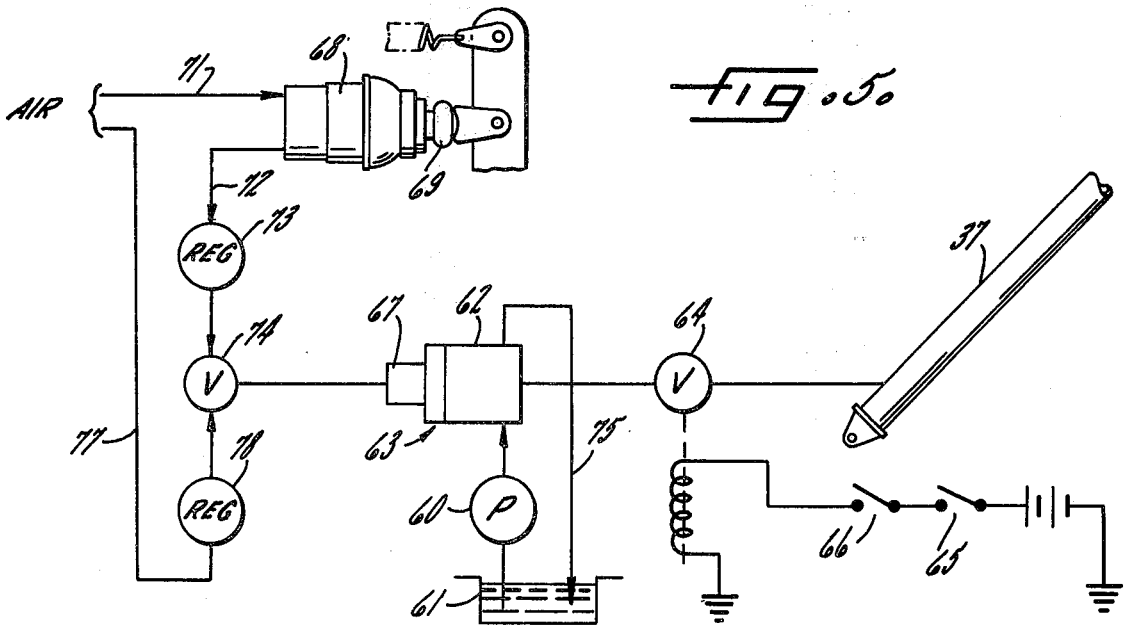
FIG. 5 is a schematic circuit diagram for the compensating system of the present invention; and, FIG. 6 is a side elevation of a tower crane embodying the compensating system of the present invention.

Turning now to FIG. 5, there is shown a schematic control circuit for the boom stop compensating system of the present invention. As shown here a pump 60, preferably of the high pressure, fixed displacement type, delivers hydraulic fluid from a reservoir 61 through one section 62 of a regulator valve 63 and a solenoid operated shut-off valve 64 to the boom stop cylinders 37. The solenoid valve 64 is normally biased closed to trap fluid in the cylinders 37 when the crane engine is not running. The solenoid is energized to open the valve 64 by an electrical circuit when the engine ON—OFF switch 65 is turned ON and an engine oil pressure switch 66, connected in series closes. Thus the valve 64 prevents leakage of fluid out of the cylinders 37 when the crane engine is shut down.

Figure 4:
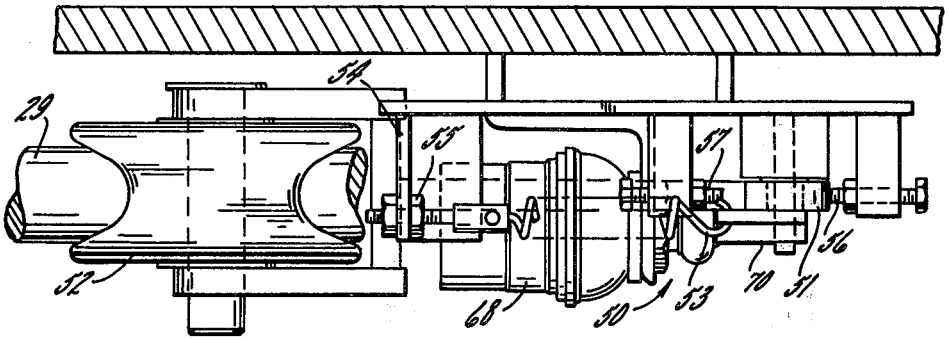
FIG. 4 is a fragmentary plan view as seen along line 4—4 in FIG. 3.

In order to regulate the hydraulic pressure delivered to the cylinders 37, the sensing means 50 transmits a pressure signal to a second section 67 of the regulator valve 63 inversely proportional to the tension on the boom hoist line 29. As shown in FIGS. 3–5, the sensing means 50 includes a proportional valve 68 having an operator 69 engageable by an abutment 70 carried on one leg of the bell crank 51. When the bell crank 51 rotates clockwise (FIG. 2) due to increasing tension in the boom hoist line 29, the operator 69 extends and progressively closes the valve 68.

In this illustrated embodiment, the regulator 63 has a pneumatic section 67 and a hydraulic section 63 and the proportional valve 68 is an air valve which receives air under pressure through a supply line 71 from a source such as a pump and tank or manifold (not shown). Since air in the supply line 71 may vary from a minimum tank pressure of about 120 psi to a maximum of about 135 (when the pump shuts off) the output line 72 from the valve may include a maximum pressure regulator 73 set to limit the output to 120 psi.

From the proportional valve 68, the air passes through line 72, maximum regulator 73 and a shuttle valve 74 into the pneumatic section 62 of the regulator 63. Preferably the hydraulic pump 60 has a pressure rating of about 2400 psi and the regulator 63 has an air to hydraulic pressure ratio of about 1:20. Thus, if the air pressure from the proportional valve 68 is 100 psi, the hydraulic pressure delivered by the pump 60 to the cylinders 37 will be 2000 psi. The hydraulic section 62 of the regulator also functions as an internal relief valve and excess fluid is returned to the tank 61 through a return line 75.

Figure 2:
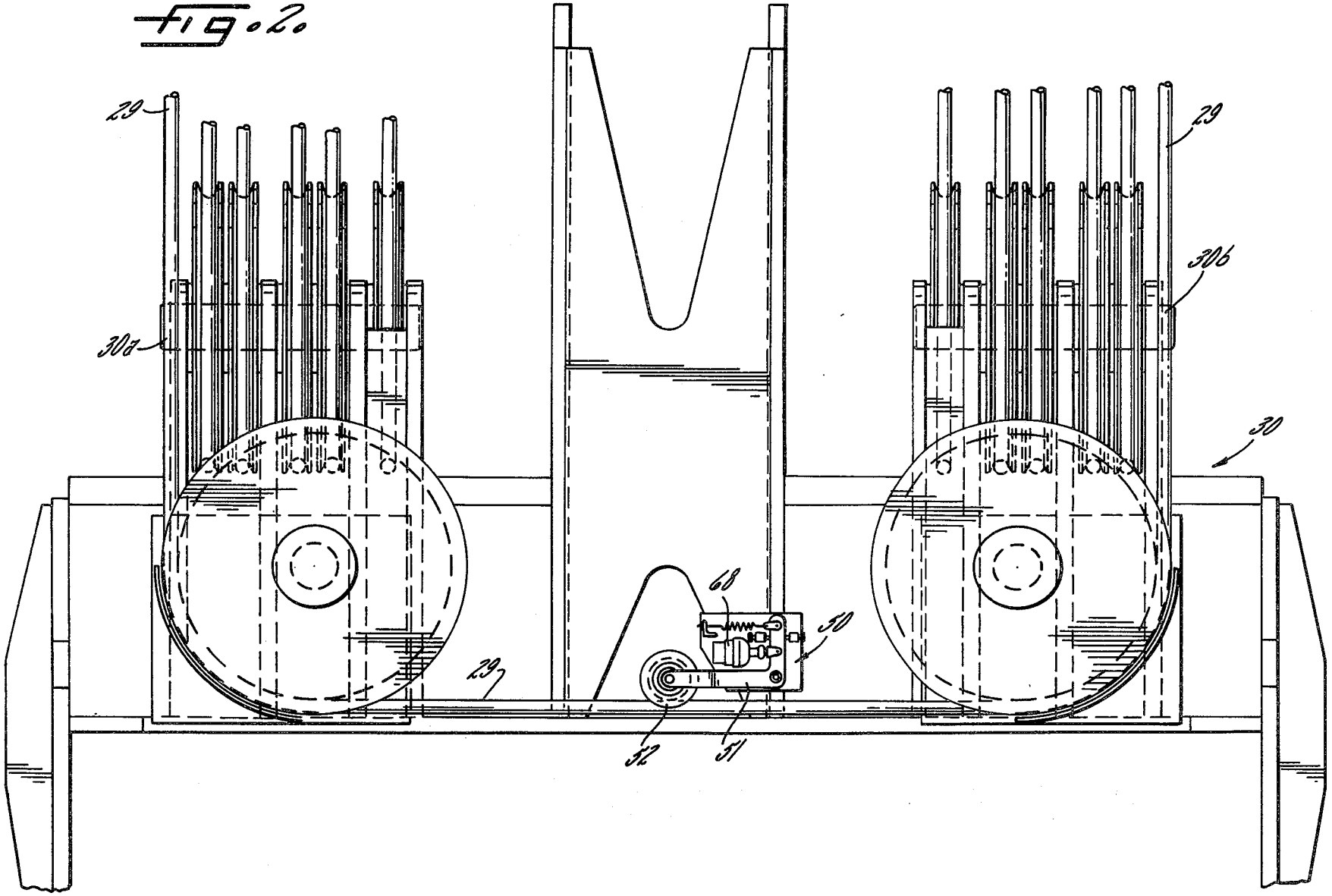
FIG. 2 is an enlarged, fragmentary elevation of the upper equalizer assembly for the boom hoist rigging of the lift crane shown in FIG. 1.

So that the hydraulic pressure in the boom stop cylinders 37 does not fall too low (when there is substantial tension in the boom hoist line 29 and the bell crank is rotated clockwise as in FIG. 2) the compensating system preferably includes a second air supply line 77 connected to the air section 67 of the regulator 63 through a minimum air regulator 78 and the shuttle valve 74. This minimum regulator 78 may be set at 30 psi, for example, so that the hydraulic pressure delivered to the cylinders 37 will always be at 600 psi or more.

From the foregoing, it will be appreciated that when the boom hoist line 29 is subjected to substantial tension, as when a load is suspended from the boom 24, the sensing means 50 closes the proportional valve 68 down and air passes through the minimum regulator 78 to the two stage regulator 63 which delivers hydraulic pressure at 600 psi to the cylinders 37. As the tension in the boom hoist line 29 decreases, as when a load is set down, the proportional valve 68 progressively opens sending an increased pressure signal to the regulator 63. This substantially increases the pressure in the boom stop cylinders 37 and serves to automatically compensate for the rearward force on the boom exerted by the overhanging weight of the masts 27 and equalizer assembly 30. Of course, as the pressure increases in the cylinders 37 they tend to push the boom 24 forward and this, in turn, increases the tension on the boom hoist line 29. Thus, the boom stop and back hitch compensation system of the present invention operates as an automatic feedback system.

Figure 6:
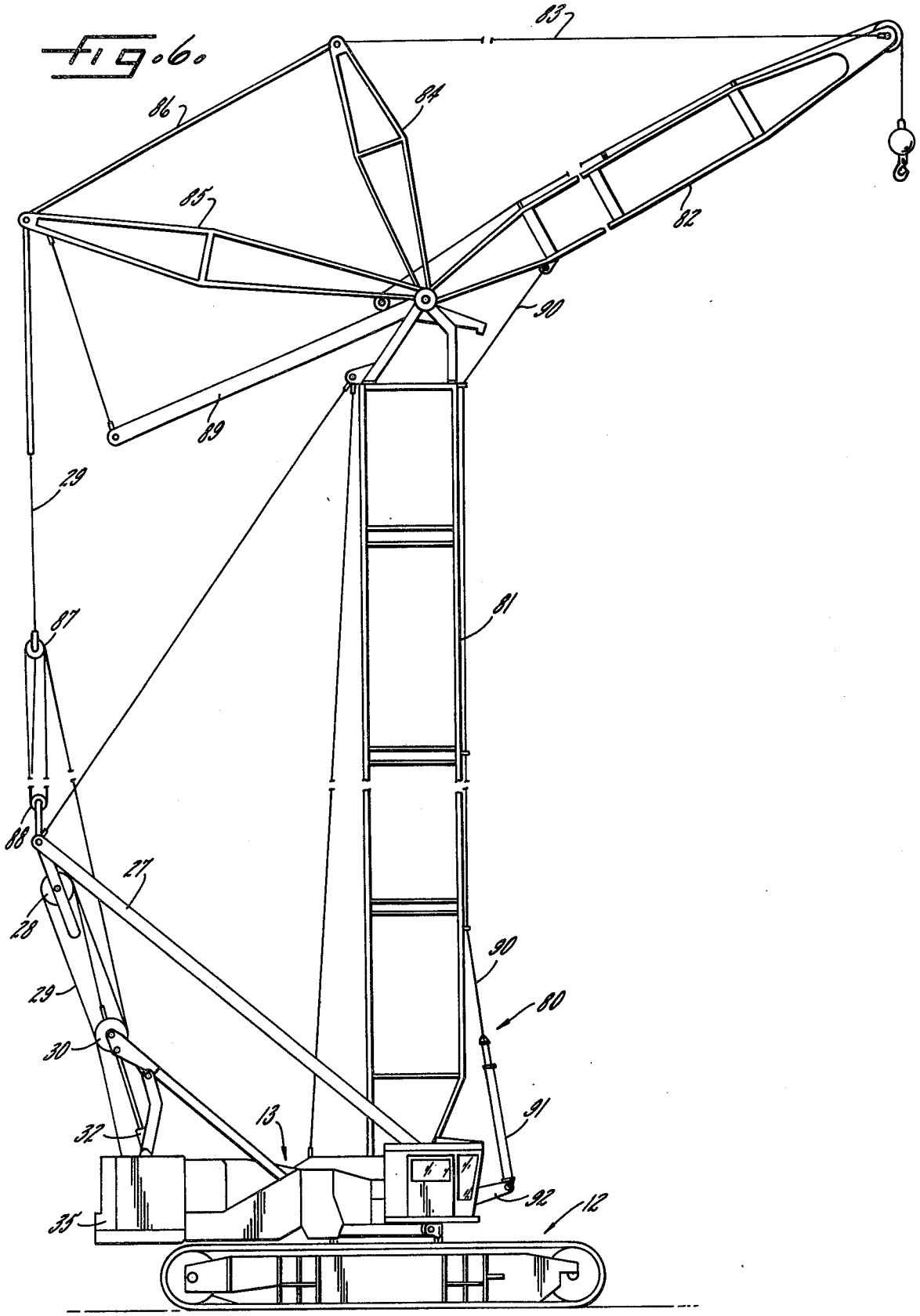

Pursuant to another aspect of the present invention, the compensating system may also be employed in connection with a hold back means for a tower crane. Turning now to FIG. 6, there is shown a tower crane 80 which incorporates the compensating system of the present invention. As shown here, the crane lower works 12 and most of the upper works 13 are the same as the crane 10 shown in FIG. 1. Thus the crane 80 includes masts 27, equalizers 28 and 30, back hitch cylinders 32 and boom hoist line 29. The crane 80 also includes a tower 81 with a pivotally mounted jib boom 82 at its upper end.

For supporting the jib boom 82, a suspension line 83 runs from the boom tip to an upper boom strut 84 which is, in turn, connected to an intermediate strut 85 by straps 86. In working position, the intermediate strut is connected to the boom hoist line 29 through an additional set of equalizers 87 and 88. As the boom hoist line is reeved in, the jib boom 82 is raised. A main strut 89 also extends rearwardly from the jib 82 and engages a spreader (not shown) when the jib is lowered into folded relation along the front of the tower 81.

To prevent the jib boom 82 from rotating backward when a load is set down, the tower crane includes a hold-back line 90 connected to the jib (or one of the struts) and a hold-back cylinder 91 carried on the crane upper works 13 by a frame element 92. When the tension in the boom hoist line 29 decreases, the sensing valve 68 and regulator 63 increase the hydraulic pressure delivered to the top of the cylinder 91. This counteracts the rearward tipping force exerted on the jib boom 82 due to the overhanging weight of the struts, boom hoist line 29 and equalizer assemblies 28, 30, 87 and 88.

We claim as our invention:

1. A boom stop compensating system for a load lifting device having a power source, a boom mounted for vertically pivoting movement, boom hoist rigging including a back hitch assembly and a boom hoist line for raising and lowering the boom and boom stop cylinder means for limiting the vertical angle to which the boom may be raised comprising, in combination, pump means for delivering fluid under pressure to the boom stop cylinder, means for sensing changes in tension in the boom hoist rigging, and regulating means interposed between said cylinders and said sensing means for increasing the fluid pressure delivered to said cylinders by said pump means as the tension in said boom hoist rigging decreases.

2. A boom stop compensating system as defined in claim 1 including a valve interposed between said regulating means and said cylinder and means for closing said valve when said power source is not operating to lock fluid in said cylinder.

3. A boom stop compensating system as defined in claim 2 wherein said power source includes an internal combustion engine with an oil pump, said valve is solenoid operated and normally biased closed and said solenoid is energized to open said valve by series electrical circuit means including a first switch closed when said engine is turned ON and a second switch closed when the pressure delivered by said oil pump reaches a predetermined level.

4. A boom stop compensating system as defined in claim 1 wherein said regulating means includes a first fluid pressure section for receiving proportional pressure signals from said sensing means and a second fluid pressure section for regulating the fluid pressure in said cylinder at a multiple of the pressure in said first section.

5. A boom stop compensating system as defined in claim 4 wherein said first section is pneumatic and said second section is hydraulic and said sensing means includes a source of pneumatic pressure and a proportional valve arranged to decrease the pressure signal from said source to said first section as the tension in said boom hoist rigging increases.

6. A boom stop compensating system as defined in claim 5 wherein said proportional valve is operated by a lever biased against said boom hoist cable.

7. A boom stop compensating system as defined in clain 6 wherein said sensing means includes a penumatic regulator interposed between said source and said first section for establishing the minimum pressure signal delivered to said first section.

8. A boom stop compensating system as defined in claim 1 wherein said device is a lift crane, said boom stop cylinder is hydraulically actuated and effective to cushion said boom through a range of angular movement approaching vertical, said pump means delivers hydraulic fluid to said cylinder, and said regulating means adjusts the hydraulic pressure in said cylinder inversely in proportion to the tension in said boom hoist rigging.

9. A boom stop compensating system as defined in claim 1 wherein said device is a tower crane having a pivotally mounted jib boom, said boom stop cylinder is hydraulically actuated, said pump means delivers hydraulic fluid to said cylinder, and said regulating means adjusts the hydraulic pressure in said cylinder inversely in proportion to the tension in said boom hoist rigging.

10. A boom stop compensating system as defined in claim 1 wherein said device includes a pivotally mounted mast secured to said boom by pendants and carries an upper equalizer assembly around which said boom hoist line runs as a multi-part line and said sensing means is carried by said equalizer assembly and detects changes in tension in said boom hoist line.

* * * * *